US005397124A

United States Patent [19]

Nevel

[11] Patent Number: 5,397,124

[45] Date of Patent: Mar. 14, 1995

[54] BASEBALL FLIP TOY

[76] Inventor: Roy E. Nevel, Box 236, St. Petersburg, Pa. 16054

[21] Appl. No.: 223,004

[22] Filed: Apr. 5, 1994

[51] Int. Cl.[6] ..... A63H 33/18; A63F 7/20

[52] U.S. Cl. ..... 273/88; 273/344; 273/DIG. 25

[58] Field of Search ..... 273/88, DIG. 25, 424, 273/416, 428, 338, 339, 344, 58 K, 446, 92; D21/48, 49, 82, 2

[56] References Cited

U.S. PATENT DOCUMENTS

| | | | |
|---|---|---|---|
| D. 122,424 | 9/1940 | Singer | 273/344 |
| 1,918,718 | 7/1933 | Samsel | 273/DIG. 25 |
| 2,002,077 | 5/1935 | Darling | 273/DIG. 25 |
| 2,187,524 | 1/1940 | Price | 273/344 |
| 2,219,130 | 10/1940 | Herrmann | 273/DIG. 25 |
| 2,274,208 | 2/1942 | Mull | 273/344 |
| 2,846,809 | 8/1958 | Majewski | 273/DIG. 25 |
| 3,158,954 | 12/1964 | Green | 446/92 |
| 3,655,193 | 4/1972 | Jones | 273/DIG. 25 |
| 3,709,495 | 1/1973 | Krombein | 273/344 |
| 5,199,716 | 4/1993 | DeFluiter | 273/344 |

*Primary Examiner*—Sebastiano Passaniti

[57] ABSTRACT

A baseball flip toy for playing a simulated game of baseball comprising a game piece further comprising an essentially rectangular body having a first end, a second end, and an intermediate portion therebetween, the intermediate portion further having top and bottom walls with side walls extended therebetween; and first, second, third, and fourth plungers with the first, second, and third plungers coupled to the second end of the body and extended therefrom, and the fourth plunger coupled to the first end of the body and extended therefrom; whereby when the game piece is initially placed in operation, the first plunger is coupled to an external and generally level surface, and when a user pulls upward on the body, the first plunger is forcibly released from the surface, causing the body to ascend, thus upon its descent, when the first plunger adheres to the surface, a single base hit is declared, when the second plunger adheres to the surface, a double base hit is declared, when the third plunger adheres to the surface, a triple base hit is declared, when the fourth plunger adheres to the surface, a home run is declared, when the top wall of the body contacts the surface, a "walk" is declared, and when either side wall of the body contacts the surface, an "out" is declared.

3 Claims, 4 Drawing Sheets

BASEBALL FLIP TOY

BACKGROUND OF THE INVENTION

1. Field of the Invention

The present invention relates to a baseball flip toy and more particularly pertains to playing a simulated game of baseball with a baseball flip toy.

2. Description of the Prior Art

The use of toys is known in the prior art. More specifically, toys heretofore devised and utilized for the purpose of simulating sporting games are known to consist basically of familiar, expected and obvious structural configurations, notwithstanding the myriad of designs encompassed by the crowded prior art which have been developed for the fulfillment of countless objectives and requirements.

By way of example, U.S. Pat. Des. No. 262,223 to Raymond discloses a projectile for toss game. U.S. Pat. Des. No. 271,890 to Astwood, Sr. discloses a dart baseball game board. U.S. Pat. Des. No. 301,899 to Cook discloses an object toss skill game. U.S. Pat. Des. No. 329,469 to Franklin et al. discloses a dart board baseball game. U.S. Pat. No. 4,989,880 to Gettemeier et al. discloses a tossing game apparatus.

While these devices fulfill their respective, particular objective and requirements, the aforementioned patents do not describe a baseball flip toy that allows a user or group of users to play a simulated game of baseball.

In this respect, the baseball flip toy according to the present invention substantially departs from the conventional concepts and designs of the prior art, and in doing so provides an apparatus primarily developed for the purpose of playing a simulated game of baseball.

Therefore, it can be appreciated that there exists a continuing need for new and improved baseball flip toy which can be used for playing a simulated game of baseball. In this regard, the present invention substantially fulfills this need.

SUMMARY OF THE INVENTION

In the view of the foregoing disadvantages inherent in the known types of toys now present in the prior art, the present invention provides an improved baseball flip toy. As such, the general purpose of the present invention, which will be described subsequently in greater detail, is to provide a new and improved baseball flip toy and method which has all the advantages of the prior art and none of the disadvantages.

To attain this, the present invention essentially comprises, in combination, an essentially planar and rectangular playing board; a game piece further comprising an elongated and essentially rectangular body having a first end, a second end, and an intermediate portion therebetween, the intermediate portion further having opposed top and bottom walls with opposed side walls extended between the top and bottom walls, the bottom wall further having a notch thereon defining a finger grip near the first end adapted for receipt of a tip of a finger; and a first plunger, a second plunger, a third plunger and a fourth plunger, each plunger further comprising an elongated rod having one support end with the other end remote from the support end coupled to a suction cup adapted to adhere to the playing board, the support end of the first plunger coupled to the second end of the body and extended away from the intermediate portion thereof at an acute angle, the support end of the second plunger coupled to the second end of the body and extended away from the intermediate portion thereof at an obtuse angle, the support end of the third plunger coupled to the second end of the body and axially extended therefrom with the first plunger, second plunger, and third plunger terminating at generally the same radial extent from the second end of the body, and the support end of the fourth plunger coupled to the first end of the body and axially extended therefrom with the first plunger, second plunger, third plunger, fourth plunger, and body planarly aligned; whereby when the game piece is initially placed in operation, the suction cup of the first plunger is coupled to the playing board and the peripheral edge of the suction cup of the fourth plunger rests upon the playing board such that the second end of the body is extended upwards therefrom at an acute angle, and when a user acting as a batter on a baseball team places a finger within the finger grip of the body and pulls upward, the suction cup of the first plunger is forcibly released from the playing board, causing the body to ascend and generally rotate about its second end, thus upon its descent, when the suction cup of the first plunger adheres to the playing board, a single base hit for the batter is declared, when the suction cup of the second plunger adheres to the playing board, a double base hit for the batter is declared, when the suction cup of the third plunger adheres to the playing board, a triple base hit for the batter is declared, when the suction cup of the fourth plunger adheres to the playing board, a home run for the batter is declared, when the top wall of the body contacts the playing board, a "walk" for the batter is declared, and when either side wall of the body contacts the playing board, an "out" for the batter is declared.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baseball flip toy which has all the advantages of the prior art toys and none of the disadvantages.

It is another object of the present invention to provide a new and improved baseball flip toy which may be easily and efficiently manufactured and marketed.

It is a further object of the present invention to provide a new and improved baseball flip toy which is of durable and reliable construction.

An even further object of the present invention is to provide a new and improved baseball flip toy which is susceptible of a low cost of manufacture with regard to both materials and labor, and which accordingly is then susceptible of low prices of sale to the consuming public, thereby making such a baseball flip toy economically available to the buying public.

Still yet another object of the present invention is to provide a new and improved baseball flip toy which provides in the apparatuses and methods of the prior art some of the advantages thereof, while simultaneously overcoming some of the disadvantages normally associated therewith.

Even still another object of the present invention is to provide a new and improved baseball flip toy for playing a simulated game of baseball.

Lastly, it is an object of the present invention to provide a new and improved baseball flip toy comprising a game piece further comprising an elongated and essentially rectangular body having a first end, a second end, and an intermediate portion therebetween, the intermediate portion further having top and bottom walls with side walls extended between the top and bottom walls; and a first plunger, a second plunger, a third plunger and a fourth plunger, the first plunger coupled to the second end of the body and extended therefrom, the second plunger coupled to the second end of the body and extended therefrom, the third plunger coupled to the second end of the body and extended therefrom, and the fourth plunger coupled to the first end of the body and extended therefrom; whereby when the game piece is initially placed in operation, the first plunger is coupled to an external and generally level surface and the fourth plunger rests upon the surface such that the second end of the body is extended upwards therefrom at an acute angle, and when a user pulls upward on the body, the first plunger is forcibly released from the surface, causing the body to ascend, thus upon its descent, when the first plunger adheres to the surface, a single base hit is declared, when the second plunger adheres to the surface, a double base hit is declared, when the third plunger adheres to the surface, a triple base hit is declared, when the fourth plunger adheres to the surface, a home run is declared, when the top wall of the body contacts the surface, a "walk" is declared, and when either side wall of the body contacts the surface, an "out" is declared.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
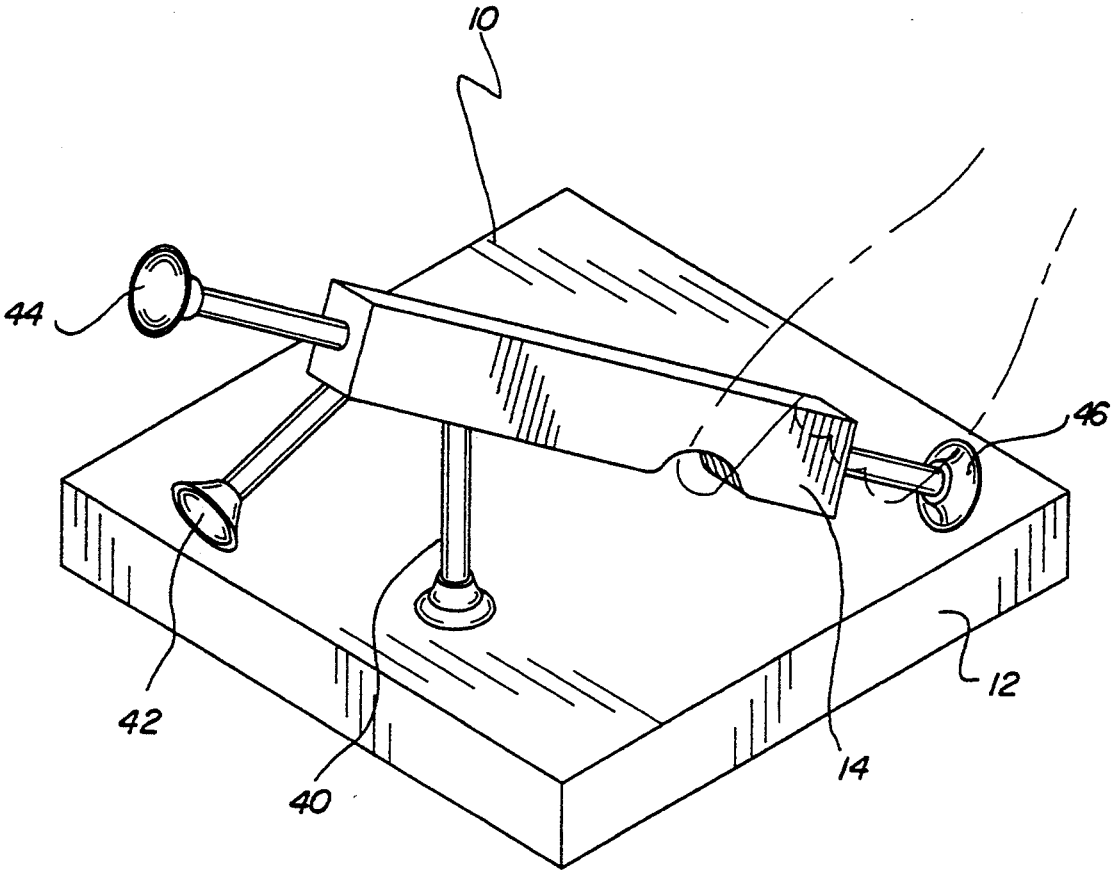
FIG. 1 is a perspective view of the preferred embodiment of the baseball flip toy constructed in accordance with the principles of the present invention.

With reference now to the drawings, and in particular, to FIG. 1 thereof, the preferred embodiment of the new and improved baseball flip toy embodying the principles and concepts of the present invention and generally designated by the reference number 10 will be described.

Specifically, the present invention includes 2 major components. The major components are the playing board and the game piece. These components are interrelated to provide the intended function.

More specifically, it will be noted in the various Figures that the first major component is the playing board 12. The playing board is essentially planar and rectangular in structure. The playing board is comprised of a surface adapted to be compatible with the game piece.

The second major component is the game piece 14. The game piece includes two subcomponents. These subcomponents are interrelated to provide the intended function.

The first subcomponent of the game piece is the body 20. The body is elongated and essentially rectangular in structure. The body has a first end 22, a second end 24, and an intermediate portion 26 therebetween. The intermediate portion includes an opposed top wall 28 and a bottom wall 30 with opposed side walls 32 extended therebetween. The bottom wall further includes a notch formed thereon defining a finger grip 34 near the first end. The fingergrip is adapted for receipt of a tip of a finger.

The second subcomponent of the game piece is the plungers. The present invention includes a first plunger 40, a second plunger 42, a third plunger 44, and a fourth plunger 46. Each plunger includes an elongated rod having one support end with the other end remote from the support end coupled to a suction cup 48. The suction cup is adapted to adhere to the surface of the playing board 12. The support end of the first plunger is coupled to the second end 24 of the body. The first plunger is extended away from the intermediate portion 26 of the body at an acute angle. The support end of the second plunger is coupled to the second end of the body. The second plunger is extended away from the intermediate portion of the body at an obtuse angle. The support end of the third plunger is coupled to the second end of the body. It is axially extended from the body. The first plunger, second plunger, and third plunger terminate at generally the same radial extent from the second end of the body. The support end of the fourth plunger is coupled to the first end of the body. It is axially extended therefrom. The first plunger, second plunger, third plunger, fourth plunger, and body are planarly aligned.

Figure 3:
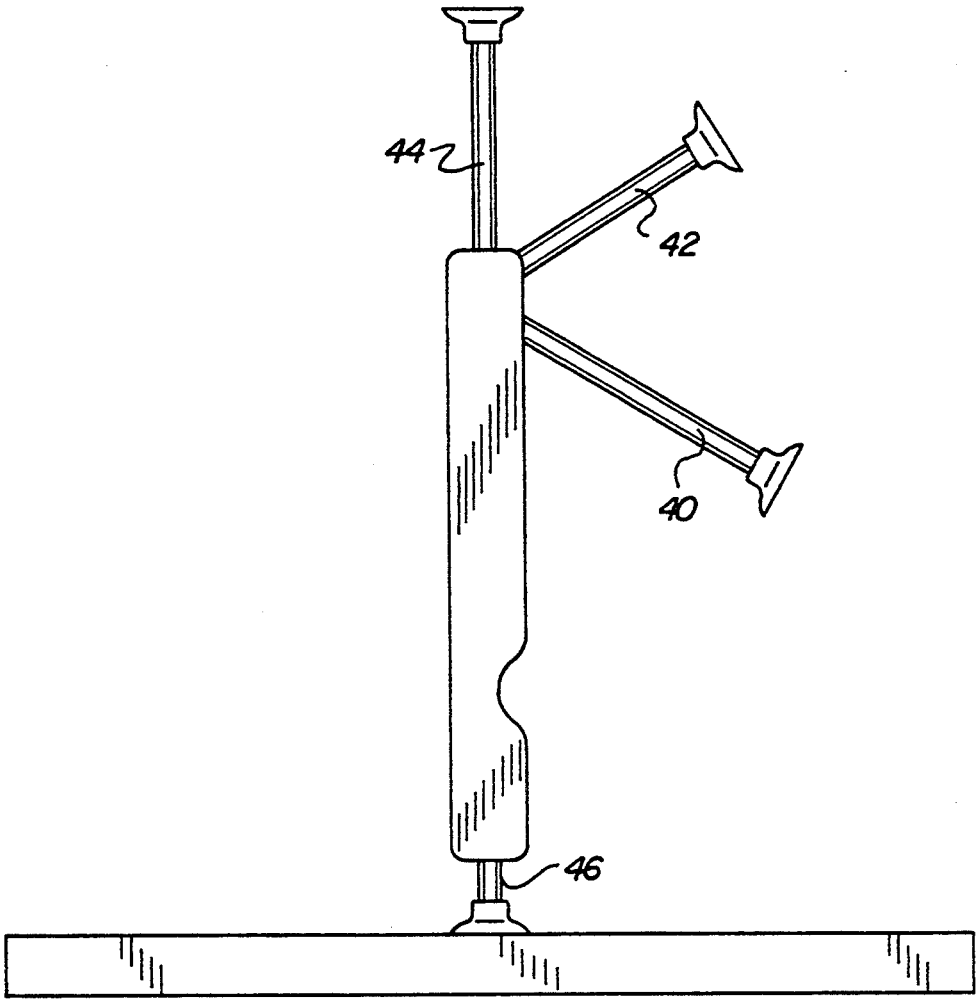
FIG. 3 is a side elevational view of the present invention positioned such that a home run is declared.
Figure 4:
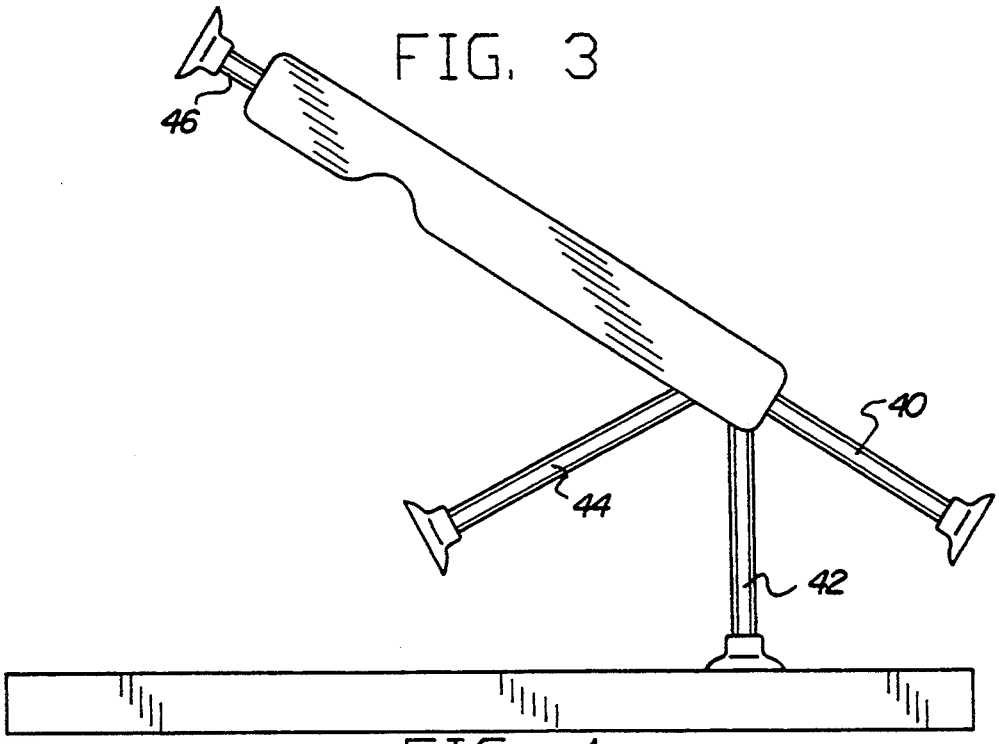
FIG. 4 is a side elevational view of the present invention positioned such that a double base hit is declared.
Figure 5:
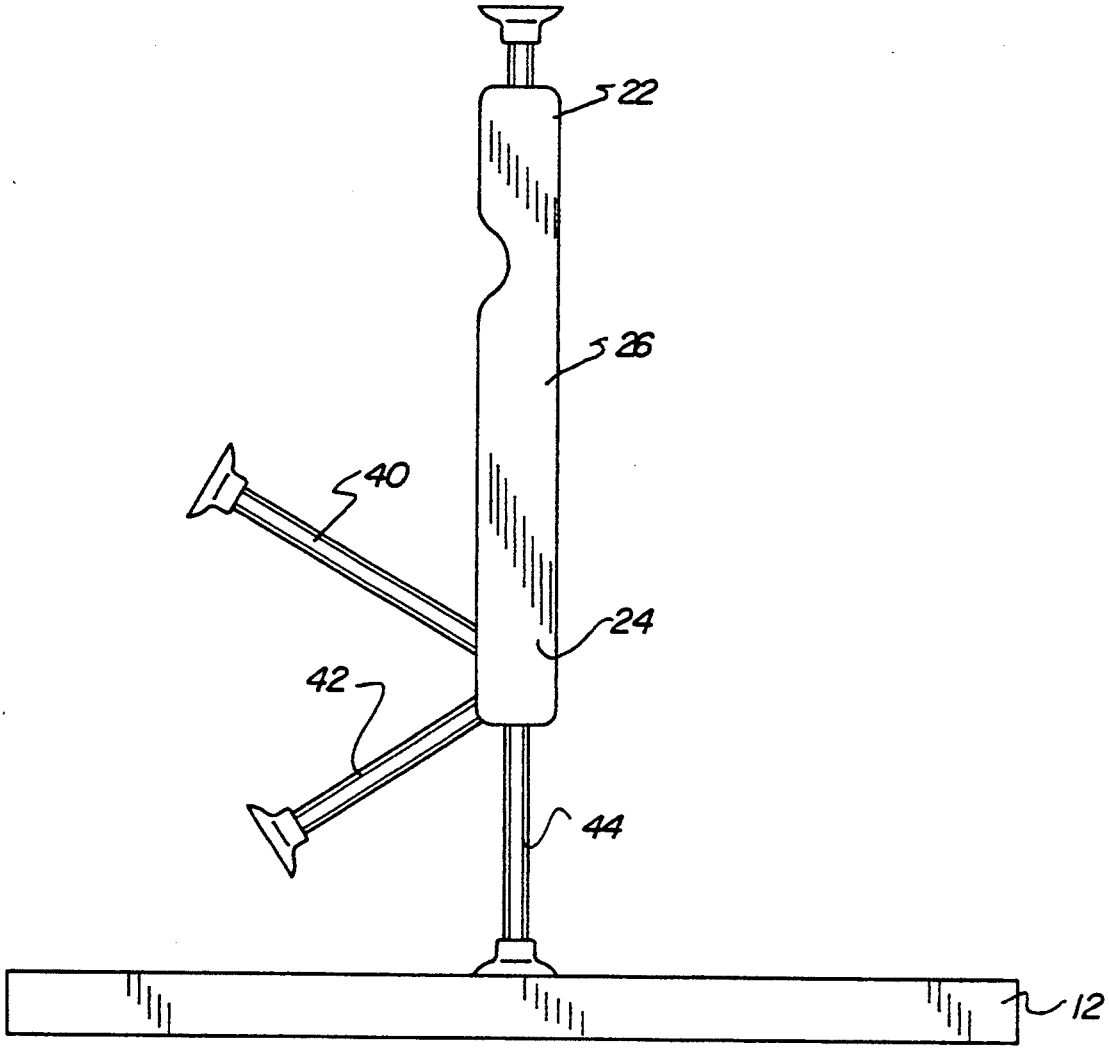
FIG. 5 is a side elevational view of the present invention positioned such that a triple base hit is declared.
Figure 6:
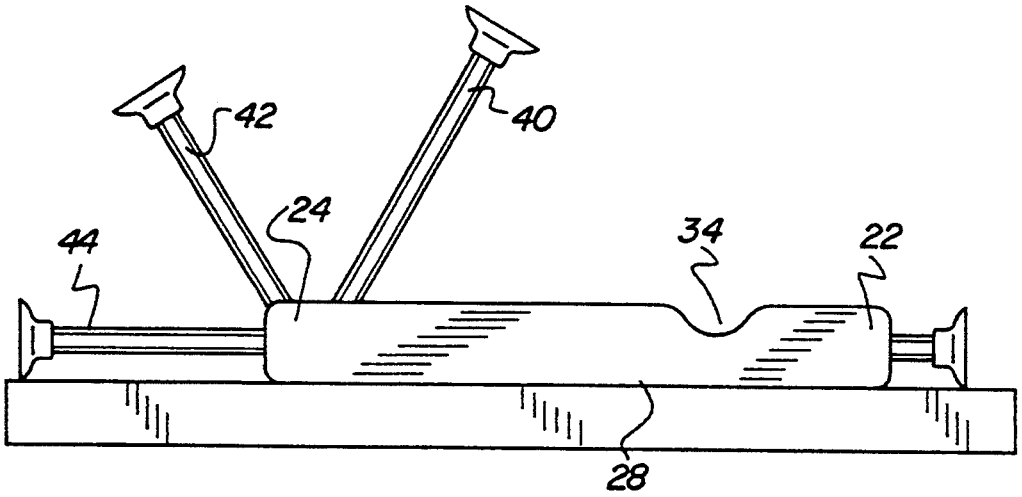
FIG. 6 is a side elevational view of the present invention positioned such that a "walk" is declared.
Figure 7:
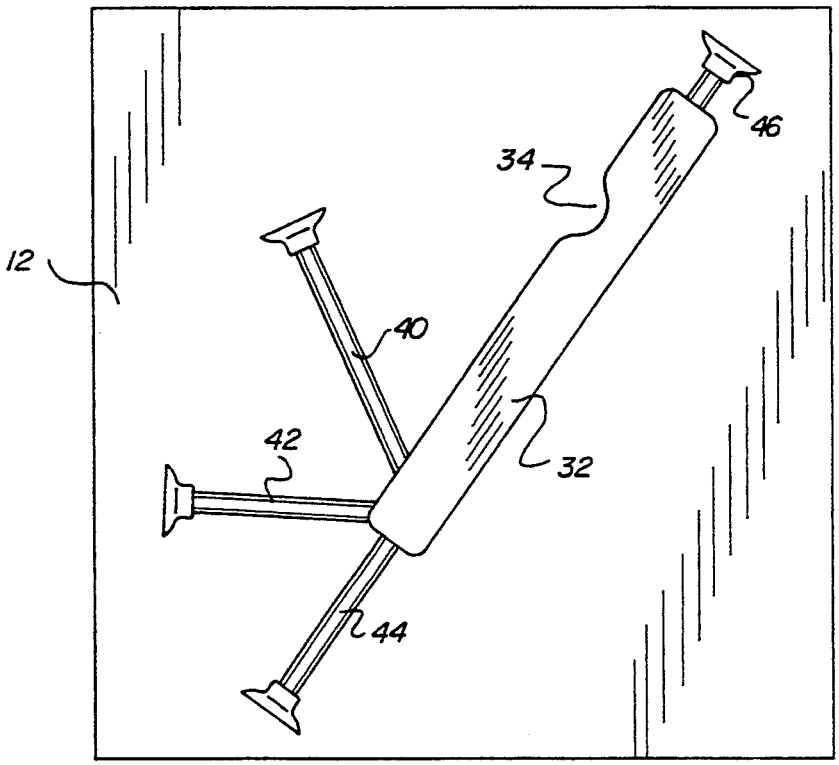
FIG. 7 is a plan view of the present invention positioned such that an "out" is declared.
Figure 8:
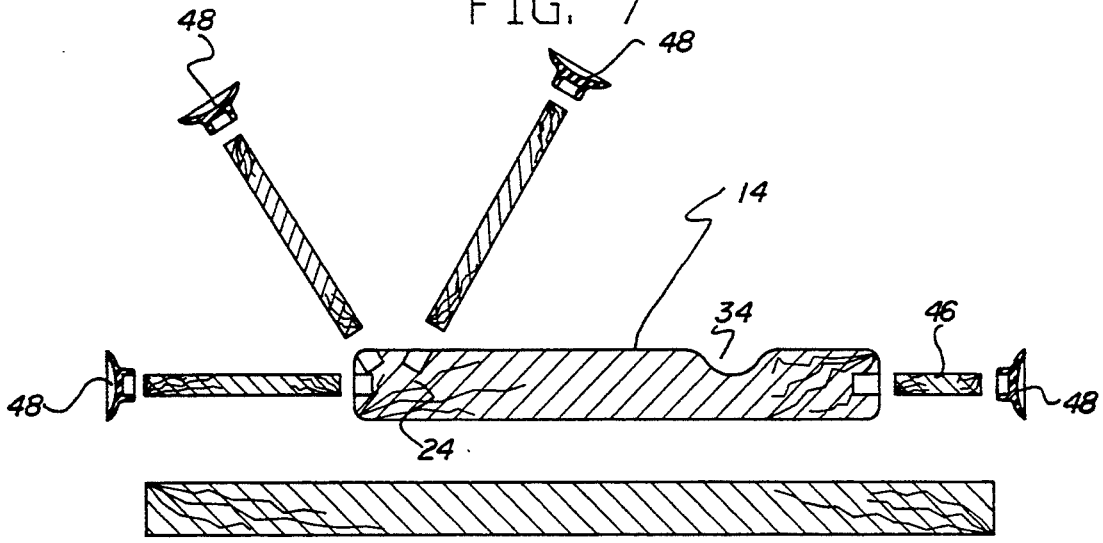
FIG. 8 is a cross-sectional view of the present invention.

When the game piece 14 is initially placed in operation, the suction cup 48 of the first plunger 40 is coupled to the playing board. The peripheral edge of the suction cup of the fourth plunger 46 rests upon the playing board 12 such that the second end of the body 24 is extended upwards therefrom at an acute angle. When a user acting as a batter on a baseball team places a finger within the fingergrip 34 of the body and pulls upward, the suction cup of the first plunger is forcibly released from the playing board, thus causing the body to ascend and generally rotate about its second end 24. The body now descends upon the playing board. If the suction cup of the first plunger adheres to the playing board, a single base hit for the batter is declared. See FIG. 2. If the suction cup of the second plunger 42 adheres to the playing board, a double base hit for the batter is declared. See FIG. 4. If the suction cup of the third plunger 44 adheres to the playing board, a triple base hit for the batter is declared. See FIG. 5. If the suction cup of the fourth plunger 46 adheres to the playing board, a home run for the batter is declared. See FIG. 3. If the top wall 28 of the body contacts the playing board, a walk for the batter is declared. See FIG. 6. Lastly, if either side wall 32 of the body contacts the playing board, an out for the batter is declared. See FIG. 7.

The present invention is a uniquely designed game for those who like playing simulated games of baseball. In the preferred embodiment, the playing board is used for a playing board and is made of plastic. The body and plungers are of the game piece are made from plastic and rubber. The body is about three to five inches long, and has a finger grip underneath it with a suction cup mounted next to the finger grip.

The present invention is a game that requires two people to play. Play begins when one player puts his finger in the finger grip and flips the game piece, attempting to attach the suction cup in the upright position. The final resting position of the toy on the playing board determines the score of the game. For example, if the toy lands with the fourth suction cup on the board, a home run is declared. If the game piece lands on its side, the an "out" is declared Once a player makes three "outs" his turn is over. The player who scores the most runs is the winner.

Figure 2:
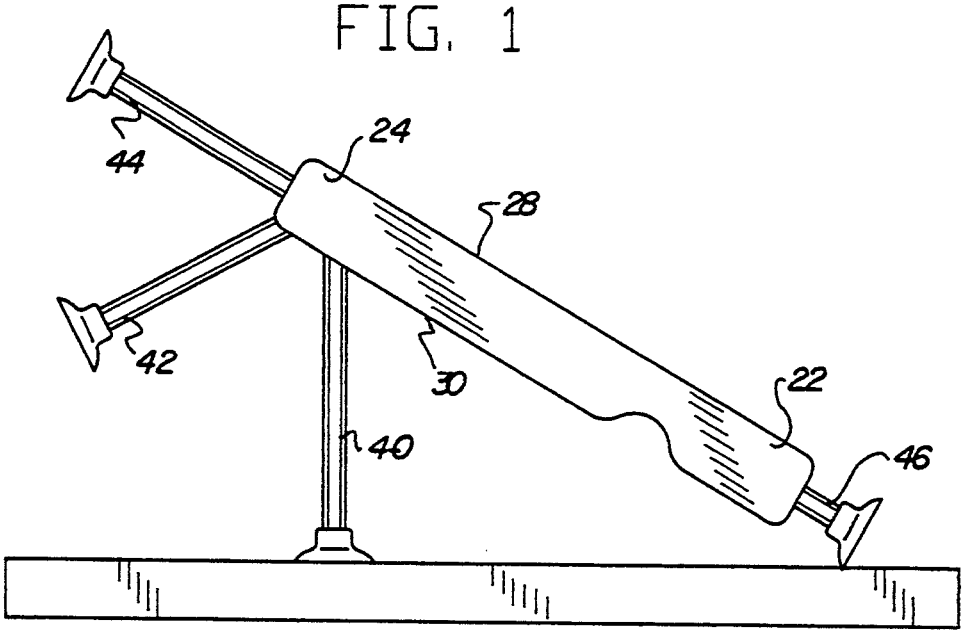
FIG. 2 is a side elevational view of the present invention positioned where a single base hit is declared.

More specifically, a top of an inning of a simulated baseball game may proceed as follows: Begin with the game piece in the starting position. Insert a pointer finger into the finger grip. Flip the game piece into the air, causing it to rotate several times. The game piece sticks in the position as shown in FIG. 2, and a single base hit is declared. The game piece is flipped a second time. The game piece now sticks in the position shown in FIG. 5, and a double base hit is declared. Now, men are on second base and third base. The third flip lands the game piece in the position shown in FIG. 7, and an "out" is declared. So, there is now 1 "out". The fourth flip lands the game piece in the position shown in FIG. 6, and a "walk" is declared. Now, the bases are loaded. The fifth flip lands the game piece in the "out" position. Now, the bases are loaded with 2 "outs". The sixth flip lands the game piece in the position shown in FIG. 5, and a home run is declared, which clears the bases and scores 4 runs. The seventh flip lands the game piece in the "out" position, thus totaling 3 "outs". It is now an opponent's turn to play the bottom of the inning.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A baseball flip toy for playing a simulated game of baseball comprising, in combination:

an essentially planar and rectangular playing board;

a game piece further comprising:

an elongated and essentially rectangular body having a first end, a second end, and an intermediate portion therebetween, the intermediate portion further having opposed top and bottom walls with opposed side walls extended between the top and bottom walls, the bottom wall further having a notch thereon defining a finger grip near the first end adapted for receipt of a tip of a finger; and a first plunger, a second plunger, a third plunger and a fourth plunger, each plunger further comprising an elongated rod having one support end with the other end remote from the support end coupled to a suction cup adapted to adhere to the playing board, the support end of the first plunger coupled to the second end of the body and extended away from the intermediate portion thereof at an acute angle, the support end of the second plunger coupled to the second end of the body and extended away from the intermediate portion thereof at an obtuse angle, the support end of the third plunger coupled to the second end of the body and axially extended therefrom with the first plunger, second plunger, and third plunger terminating at generally the same radial extent from the second end of the body, and the support end of the fourth plunger coupled to the first end of the body and axially extended therefrom with the first plunger, second plunger, third plunger, fourth plunger, and body planarly aligned;

whereby when the game piece is initially placed in operation, the suction cup of the first plunger is coupled to the playing board and the peripheral edge of the suction cup of the fourth plunger rests upon the playing board such that the second end of the body is extended upwards therefrom at an acute angle, and when a user acting as a batter on a baseball team places a finger within the finger grip of the body and pulls upward, the suction cup of the first plunger is forcibly released from the playing board, causing the body to ascend and generally rotate about its second end, thus upon its descent, when the suction cup of the first plunger adheres to the playing board, a "single base hit" for the batter is declared, when the suction cup of the second plunger adheres to the playing board, a "double base hit" for the batter is declared, when the suction cup of the third plunger adheres to the playing board, a "triple base hit" for the batter is declared, when the suction cup of the fourth plunger adheres to the playing board, a "home run" for the batter is declared, when the top wall of the body contacts the playing board, a "walk" for the batter is declared, and when either side wall of the body contacts the playing board, an "out" for the batter is declared.

2. A baseball flip toy for playing a simulated game of baseball comprising:

a game piece further comprising:

an elongated and essentially rectangular body having a first end, a second end, and an intermediate portion therebetween, the intermediate portion further having top and bottom walls with side walls extended between the top and bottom walls; and a first plunger, a second plunger, a third plunger and a fourth plunger, the first plunger coupled to the second end of the body and extended therefrom, the second plunger coupled to the second end of the body and extended therefrom, the third plunger coupled to the second end of the body and extended therefrom with the first plunger, second plunger, and third plunger terminating at generally the same radial extent from the second end of the body, and the fourth plunger coupled to the first end of the body and extended therefrom;

whereby when the game piece is initially placed in operation, the first plunger is coupled to an external and generally level surface and the fourth plunger rests upon the surface such that the second end of the body is extended upwards therefrom at an acute angle, and when a user pulls upward on the body, the first plunger is forcibly released from the surface, causing the body to ascend, thus upon its descent, when the first plunger adheres to the surface, a "single base hit" is declared, when the second plunger adheres to the surface, a "double base hit" is declared, when the third plunger adheres to the surface, a "triple base hit" is declared, when the fourth plunger adheres to the surface, a "home run" is declared, when the top wall of the body contacts the surface, a "walk" is declared, and when either side wall of the body contacts the surface, an "out" is declared.

3. The baseball flip toy as set forth in claim 2 wherein the body includes a notch formed thereon defining a finger grip adapted for receiving a tip of a finger for flipping the baseball flip toy.

* * * * *